US009899176B2

(12) United States Patent
Thorat et al.

(10) Patent No.: US 9,899,176 B2
(45) Date of Patent: Feb. 20, 2018

(54) SELF-RESETTING BIASING DEVICES FOR CURRENT LIMITING CIRCUIT BREAKER TRIP SYSTEMS

(71) Applicant: General Electric Company, Schenectady, NY (US)

(72) Inventors: Hemraj Keda Thorat, Hyderabad (IN); Mahadeva Mallappa Mittu, Hyderabad (IN); Amit Bose, Hyderabad (IN); Mahesh Jaywant Rane, Hyderabad (IN); Gajendra Vijaykumar Kadam, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/092,905

(22) Filed: Apr. 7, 2016

(65) Prior Publication Data

US 2017/0294282 A1 Oct. 12, 2017

(51) Int. Cl.

| | |
|---|---|
| ***H01H 9/00*** | (2006.01) |
| ***H01H 71/12*** | (2006.01) |
| ***H01H 71/24*** | (2006.01) |

(52) U.S. Cl.

CPC ..... *H01H 71/128* (2013.01); *H01H 71/24* (2013.01)

(58) Field of Classification Search

CPC ..... H01H 71/0228

USPC ..... 335/172, 26, 171

See application file for complete search history.

(56) References Cited

U.S. PATENT DOCUMENTS

| | | | | |
|---|---|---|---|---|
| 3,718,875 A | | 2/1973 | Kussy et al. | |
| 3,760,307 A | | 9/1973 | Patel | |
| 4,220,935 A | | 9/1980 | Wafer et al. | |
| 4,255,732 A | | 3/1981 | Wafer et al. | |
| 4,625,189 A | | 11/1986 | Lazar et al. | |
| 4,794,356 A | * | 12/1988 | Yu | H01H 71/465 200/331 |
| 5,117,210 A | * | 5/1992 | Castonguay | H01H 71/0228 335/167 |

(Continued)

OTHER PUBLICATIONS

Yu Li et al. "Improvement of Reliability of Closing Latch in Spring Type Operating Mechanism of High Voltage Circuit Breakers", Transmission and Distribution Conference and Exposition (T&D), 2012 IEEE PES, pp. 1-4, Conference Location: Orlando, FL, May 7-10, 2012.

*Primary Examiner* — Alexander Talpalatski

(74) *Attorney, Agent, or Firm* — General Electric Company

(57) ABSTRACT

A circuit breaker including a case, a trip mechanism, and a trip lever moveable between a first position and a second position. The trip lever includes a first end selectively contacting the trip mechanism and a second end opposite the first end. The circuit breaker also includes a biasing device including a housing coupled to the case and a lever arm coupled to the housing. The lever arm includes an engagement surface in contact with the second end and configured to move between an initial position corresponding to the first position and a final position corresponding to the second position. The biasing device also includes a bias member extending between the housing and the lever arm and biasing the engagement surface against the second end. The lever arm exerts a first torque in the first position and exerts a second torque different from the first torque in the second position.

20 Claims, 10 Drawing Sheets

(56) References Cited

U.S. PATENT DOCUMENTS

| | | | | | |
|---|---|---|---|---|---|
| 5,119,053 | A * | 6/1992 | Mostosi | H01H 89/08 | 335/172 |
| 5,153,544 | A * | 10/1992 | Castonguay | H01H 71/0228 | 335/167 |
| 5,343,179 | A * | 8/1994 | Pipich | H01H 71/2463 | 335/167 |
| 5,757,254 | A * | 5/1998 | Kurono | H01H 83/04 | 335/169 |
| 5,831,499 | A * | 11/1998 | Batteux | H01H 71/44 | 335/172 |
| 5,923,261 | A | 7/1999 | Castonguay et al. | | |
| 6,054,912 | A * | 4/2000 | Kaneko | H01H 71/446 | 335/167 |
| 6,222,433 | B1 * | 4/2001 | Ramakrishnan | H01H 1/2058 | 200/308 |
| 6,853,279 | B1 | 2/2005 | Puskar et al. | | |
| 7,132,911 | B2 * | 11/2006 | Chung | H01H 83/12 | 335/166 |
| 7,355,497 | B2 | 4/2008 | Germain et al. | | |
| 7,986,203 | B2 * | 7/2011 | Watford | H01H 71/0271 | 200/337 |
| 8,384,502 | B2 | 2/2013 | Gao | | |
| 8,471,655 | B2 * | 6/2013 | Woodson | H01H 77/02 | 335/26 |
| 2003/0197581 | A1 * | 10/2003 | O'Keeffe | H01H 71/2436 | 335/172 |

* cited by examiner

SELF-RESETTING BIASING DEVICES FOR CURRENT LIMITING CIRCUIT BREAKER TRIP SYSTEMS

BACKGROUND

The field of the disclosure relates generally to circuit breaker devices, and, more specifically, to self-resetting biasing devices for current limiting circuit breaker trip systems.

Known current-limiting circuit breakers interrupt circuit faults and limit the short-circuit current by utilizing a variety of electromechanical mechanisms to open the problematic circuit in a sufficiently short enough time to prevent damage to electrical components other than the circuit breaker. At least some known current-limiting circuit breakers impose an upper limit on the current that may be delivered to a load through the circuit breaker with the purpose of protecting the circuit generating or transmitting the current harmful effects due to a short-circuit or a similar problem in the load. Also, at least some known current-limiting circuit breakers utilize more than one method for sensing and reacting to increasing current (I) above a rated current and tripping the affected circuit. Further, at least some known current-limiting circuit breakers are designed to meet various requirements set forth by standards-making bodies.

In at least some known trip systems for current limiting circuit breakers, a biasing force on the trip lever increases linearly as the trip lever rotates. This results in a low biasing force for lower level current, and a large biasing force at high level fault current. In at least some known trip systems, the large biasing force at high current levels may make it difficult to trip the circuit breaker in 4-5 milliseconds (ms) in order to clear a fault in a half cycle of a fault current. As a result of the large biasing force at high current levels in at least some known trip systems, it is challenging to provide a current limiting circuit breaker device that satisfies both Underwriters Laboratories (UL) and International Electrotechnical Commission (IEC) requirements.

BRIEF DESCRIPTION

In one aspect, a circuit breaker having a case is provided. The circuit breaker includes a trip mechanism and a trip lever coupled to the case and configured to move between a first position and a second position. The trip lever includes a first end that selectively contacts the trip mechanism and a second end opposite the first end. The circuit breaker also includes a biasing device including a housing coupled to the case and a lever arm coupled to the housing. The lever arm includes an engagement surface in contact with the second end. The lever arm is configured to move between an initial position corresponding to the first position and a final position corresponding to the second position. The biasing device also includes a bias member extending between the housing and the lever arm and biasing the engagement surface against the second end, where the lever arm exerts a first torque upon the trip lever in the first position and exerts a second torque upon the trip lever in the second position, and where a value of the first torque is different from a value of the second torque.

In another aspect, a biasing device for a circuit breaker is provided. The circuit breaker includes a case, a trip mechanism, and a trip lever coupled to the case and configured to move between a first position and a second position. The trip lever includes a first end that selectively contacts the trip mechanism and a second end opposite the first end. The biasing device includes a housing coupled to the case and a lever arm coupled to the housing. The lever arm includes an engagement surface in contact with the second end. The lever arm is configured to move between an initial position corresponding to the first position and a final position corresponding to the second position. The biasing device also includes a bias member extending between the housing and the lever arm and biasing the engagement surface against the second end, where the lever arm exerts a first torque upon the trip lever in the first position and exerts a second torque upon the trip lever in the second position, and where a value of the first torque is different from a value of the second torque.

In still another aspect, a method of assembling a circuit breaker is provided. The method includes coupling a trip mechanism to a circuit breaker case. The method also includes coupling a trip lever to the circuit breaker case. The trip lever is movable between a first position and a second position. The trip lever includes a first end that selectively contacts the trip mechanism and a second end opposite the first end. The method further includes coupling a biasing device to the circuit breaker. The biasing device includes a housing coupled to the circuit breaker case and a lever arm coupled to the housing. The lever arm is movable between an initial position corresponding to the first position of the trip lever and a final position corresponding to the second position of the trip lever. The lever arm includes an engagement surface that contacts the second end. The biasing device also includes a bias member extending between the housing and the lever arm, where the bias member biases the engagement surface against the second end, where the lever arm exerts a first torque upon the trip lever in the first position and exerts a second torque upon the trip lever in the second position to facilitate self-resetting of the trip lever, where a value of the first torque is different from a value of the second torque, and where a torque characteristic of the trip lever is non-linear over a range of motion of the trip lever.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
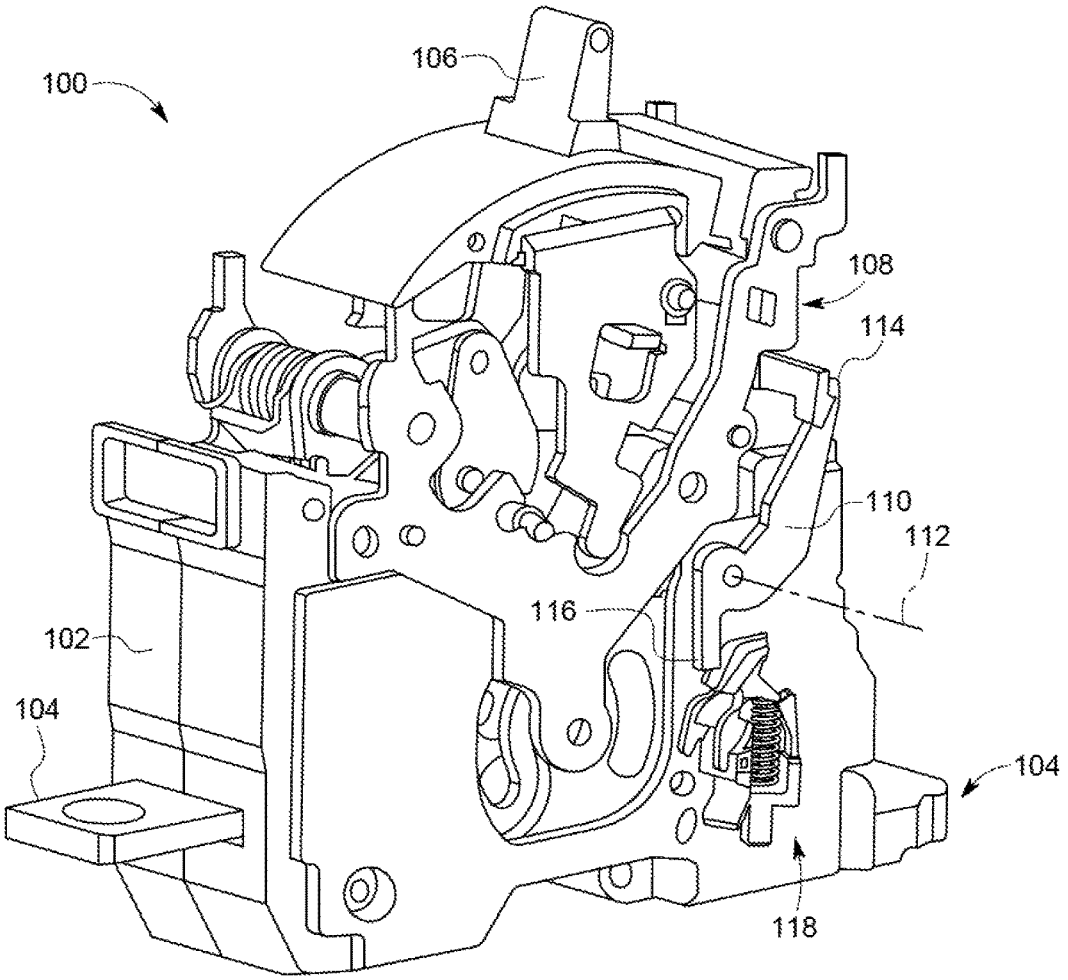
FIG. 1 is a perspective view of an exemplary embodiment of a circuit breaker.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

The self-resetting biasing devices and associated systems and methods of use thereof described herein provide non-linear opposing torque profiles to trip systems for current limiting circuit breakers. The embodiments described herein also facilitate meeting regulatory requirements that require circuit breakers to avoid tripping at lower level currents and to deliver tripping at higher level fault currents. The embodiments described herein are further suited to resetting a biasing system without manual user intervention. The self-resetting biasing devices and associated systems and methods of use thereof described herein are also suited to preventing a biasing force from being applied to trip levers after unlatching and thus, enable tripping the mechanism within a half cycle of the fault current (e.g., within 4-5 milliseconds (ms)). The embodiments described herein are further suited to enabling tuning specific circuit breaker performance characteristics including, without limitation, rated current value, time to trip when current flow exceeds rated current, and self-resetting of trip mechanisms. The embodiments described herein are further suited to providing a current limiting circuit breaker device suitable for applications demanding both Underwriters Laboratories (UL) and International Electrotechnical Commission (IEC) requirements.

FIG. 1 is a perspective view of an exemplary embodiment of a circuit breaker 100. In the exemplary embodiment, circuit breaker 100 includes a case 102 providing structural support and protection for internal components of circuit breaker 100. Circuit breaker 100 also includes terminal connectors 104 for connecting circuit breaker 100 to electrical power lines (not shown). Circuit breaker 100 further includes a trip indicator 106 which provides a visual indication of a switched state of circuit breaker 100 to a user (i.e., whether circuit breaker 100 is tripped or not). Circuit breaker 100 also includes a trip mechanism 108 rotatably coupled to circuit breaker 100 which rotates upon being contacted by a trip lever 110. In other embodiments, trip mechanism 108 is not rotatably coupled to circuit breaker 100, but rather is coupled to circuit breaker 100 to facilitate linear movement, rather than rotational movement of trip mechanism 108. Trip lever 110 is also rotatably coupled to circuit breaker 100 and rotates about a trip lever rotational axis 112. In other embodiments, trip lever 110 is not rotatably coupled to circuit breaker 100, but rather is coupled to circuit breaker 100 to facilitate linear movement, rather than rotational movement of trip lever 110. Trip lever 110 includes a first end 114 and a second end 116 opposite first end 114.

Also, in the exemplary embodiment, circuit breaker 100 includes a biasing device 118 coupled to case 102. Biasing device 118 contacts second end 116 of trip lever 110 and is configured to bias rotation of trip lever 110, as described in further detail below with reference to FIGS. 2-4. In other embodiments, biasing device 118 contacts second end 116 of trip lever 110 and is configured to bias linear movement, rather than rotation, of trip lever 110. In operation, in the exemplary embodiment, circuit breaker 100 is configured to enable flow of current between terminal connectors 104 within a range of current values, i.e., a rated current. As the current flow through circuit breaker 100 begins to exceed the rated current, a rotatable device, including, without limitation, a magnetic coil-based device (not shown), inside case 102 experiences a torque, including, without limitation, an electromechanically-generated torque, in proportion to the degree to which the current flow exceeds the rated current. The rotatable device is coupled to trip lever 110 and exerts a torque to rotate trip lever 110. In other embodiments, the rotatable device exerts a torque to move trip lever 110 in a linear direction, rather than to rotate trip lever 110. In the exemplary embodiment, prior to the current flow exceeding the rated current, an initial gap (not shown) exists between first end 114 of trip lever 110 and a portion of trip mechanism 108 proximate first end 114, such that first end 114 is not in contact with trip mechanism 108. At such times, trip lever 110 is in a first position representative of a low current condition of circuit breaker 100.

Further, in operation of the exemplary embodiment, as current flow begins to exceed rated current, rotatable device begins to rotate trip lever 110, e.g., in a counterclockwise direction relative to the view shown in FIG. 1, and the initial gap begins to close between first end 114 and trip mechanism 108. As current flow exceeds rated current still further over a period of time, continued rotation of rotatable device and thus trip lever 110 causes first end 114 to contact trip mechanism 108. Upon still further increases in current flow, continued rotation of trip lever 110 causes movement of trip mechanism 108 and eventual tripping of the circuit breaker 100 to disable current flow between terminal connectors 104. In other embodiments, not shown, continued rotation of the rotatable device with increasing current flow above the rated current causes continued linear movement of trip lever 110, leading to contact of first end 114 with trip mechanism 108, and eventual tripping of the circuit breaker 100. Upon tripping of circuit breaker 100, trip lever 110 is in a second position representative of a tripped condition of circuit breaker 100.

Furthermore, in operation of the exemplary embodiment, biasing device 118 is biased against second end 116 of trip lever 110. Thus, biasing device 118 allows circuit breaker 100 to be tuned for specific performance characteristics including, without limitation, rated current value, time to trip when current flow exceeds rated current, as well as facilitating self-resetting of trip mechanism. As described in further detail below with reference to FIGS. 2-4, biasing device 118 facilitates a non-linear biasing torque characteristic as trip lever 110 transitions from first position to second position. This non-linear biasing torque characteristic facilitates self-resetting of trip lever 110 after circuit breaker 100 is tripped, as described herein.

Figure 2:
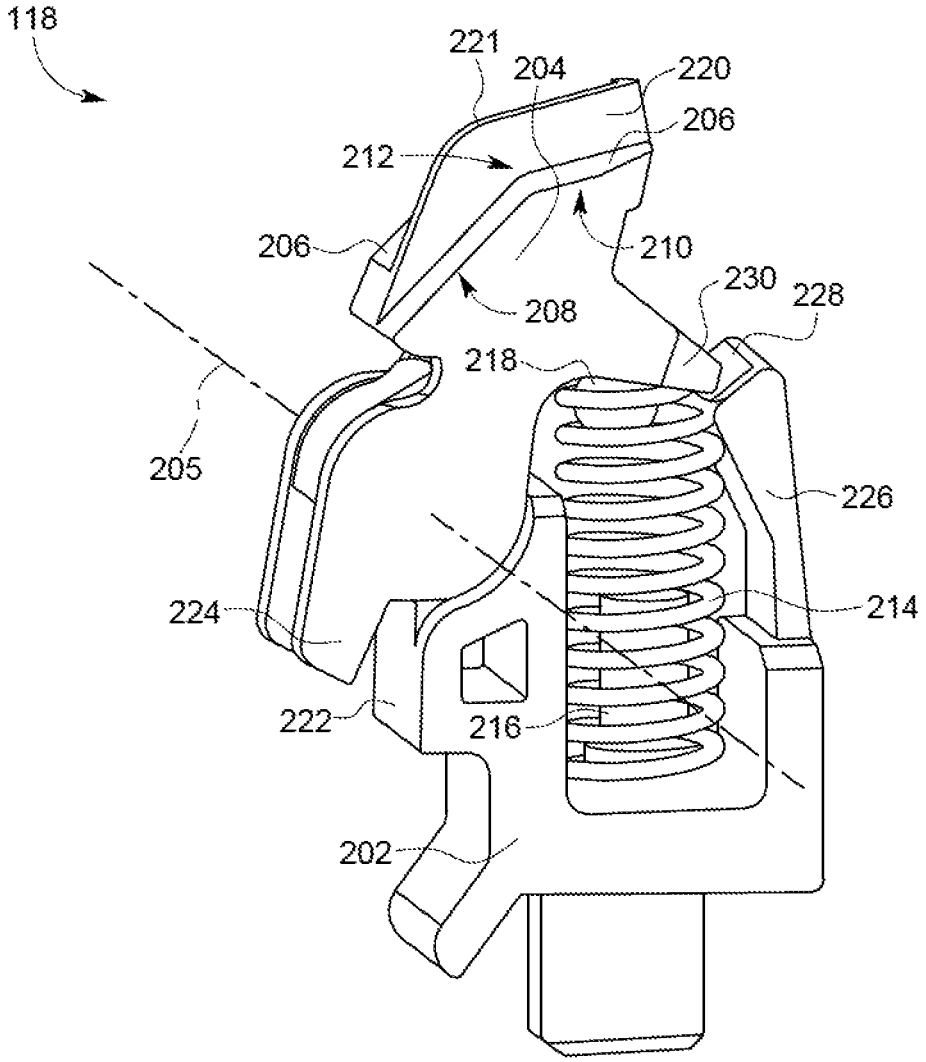
FIG. 2 is a perspective view of an exemplary embodiment of a biasing device that may be used in the circuit breaker shown in FIG. 1.

FIG. 2 is a perspective view of an exemplary embodiment of biasing device 118 that may be used in circuit breaker 100 shown in FIG. 1. In the exemplary embodiment, biasing device 118 includes a housing 202 coupled to circuit breaker 100, not shown. A lever arm 204 is rotatably coupled to housing 202 and rotates about a lever arm axis of rotation 205. In other embodiments, lever arm 204 is not rotatably coupled to housing 202, but rather is coupled to housing 202 to facilitate linear movement, rather than rotational movement, of lever arm 204. Lever arm 204 includes an engagement surface 206 in contact with second end 116 of trip lever 110 (shown in FIG. 1). Engagement surface 206 includes a first portion 208 and a second portion 210. In the exemplary embodiment, first portion 208 is oriented at a different angle than second portion 210. A rounded transition portion 212 extends between first 208 and second 210 portions. In other embodiments, engagement surface 206 may not include rounded transition portion 212.

Also, in the exemplary embodiment, biasing device 118 includes a bias member 214 (including, without limitation, a coil spring) extending between housing 202 and lever arm 204. Bias member 214 is secured between housing 202 and lever arm 204 by a housing bias member securement piece 216 and a lever arm securement piece 218 between bias member 214 and lever arm 204, respectively. Bias member 214 biases engagement surface 206 against second end 116 of trip lever 110. Also, in the exemplary embodiment, lever arm 204 includes a divider 220 which separates engagement surfaces 206 from a second engagement surface 221 to accommodate contact between bias member 214 and two trip levers 110, for example as shown and described below with reference to FIG. 6. In other embodiments, lever arm 204 may include a single engagement surface 206. In still other embodiments, lever arm 204 may not include divider 220.

Also, in the exemplary embodiment, biasing device 118 includes a stop surface 222. Lever arm 204 also includes a protrusion 224 configured to contact stop surface 222 to restrict a rotation of lever arm 204. Biasing device 118 also includes an additional bias member 226 (including, without limitation, a leaf spring, a torsion spring, a ball catch mechanism, and a cam-biased spring mechanism) extending between housing 202 and lever arm 204. Additional bias member 226 includes a bias surface 228 that contacts an extension 230 of lever arm 204. Additional bias member 226 further biases (i.e., applies an amount of biasing torque in addition to biasing torque applied by bias member 214) lever arm 204 against second end 116 of trip lever 110. In other embodiments, biasing device 118 may not include additional bias member 226.

In operation, in the exemplary embodiment, as trip lever 110 rotates counterclockwise in response to current flow in circuit breaker 100 (not shown) exceeding rated current, trip lever 110 causes lever arm 204 to press against bias member 214, thus compressing bias member 214. In other embodiments, linear movement, rather than rotation, of trip lever 110 causes lever arm 204 to press against bias member 214. Compressed bias member 214 biases engagement surface 206 against second end 116 of trip lever 110. When present in the exemplary embodiment, additional bias member 226 further biases lever arm 204 against second end 116 of trip lever 110. As trip lever 110 rotates from the first position to the second position, second end 116 of trip lever 110 traverses engagement surface 206 of lever arm 204 from first portion 208 to second portion 210. The different orientations of first and second portions 208 and 210 cause different directions and magnitudes of a biasing force to be exerted upon second end 116 by engagement surface 206. As such, in operation of the exemplary embodiment, lever arm 204 exerts a first torque having a first value (or a first range of values) upon second end 116 of trip lever 110 in the first position (i.e., with first portion 208 contacting second end 116), and lever arm 204 exerts a second torque having a second value (or a second range of values) upon second end 116 of trip lever 110 in the second position (i.e., with second portion 210 contacting second end 116), thus facilitating self-resetting of trip lever 110 and trip mechanism 108 (not shown), as described below. Also, in operation of the exemplary embodiment, the value of the first torque is greater than the value of the second torque. In other embodiments, the value of the second torque is greater than the value of the first torque. The torque characteristic exhibited by circuit breaker 100 with trip lever 110 and biasing device 118, and with trip lever 110 transitioning through intermediate positions between first position and second position is a non-linear torque characteristic regardless of whether the value of the first torque is greater than or less than the value of the second torque.

Figure 3:
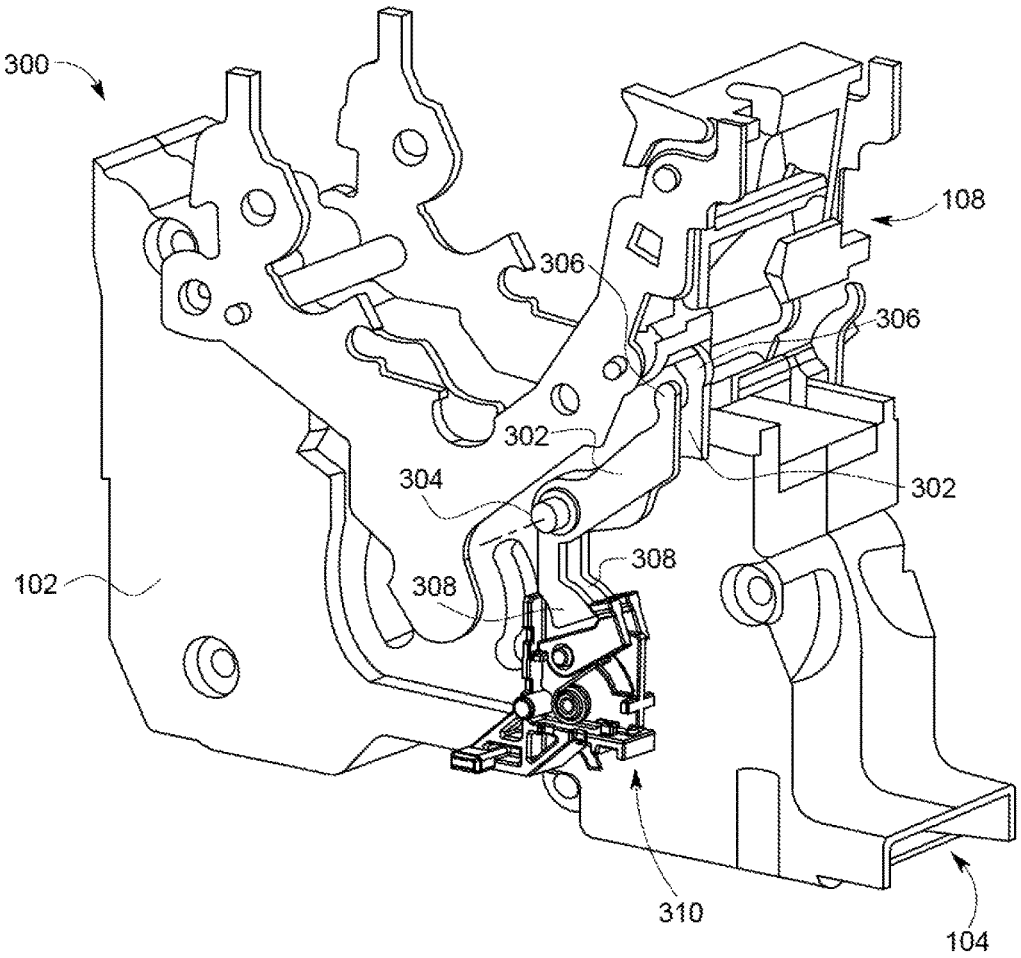
FIG. 3 is a perspective view of an alternative embodiment of a circuit breaker.

FIG. 3 is a perspective view of an alternative embodiment of a circuit breaker 300. In the alternative embodiment, circuit breaker 300 includes trip mechanism 108 (shown in FIG. 1). Circuit breaker 300 also includes trip lever 302 rotatably coupled to circuit breaker 300. Trip lever 302 rotates about a trip lever rotational axis 304, similar to trip lever 110 of circuit breaker 100 (shown in FIG. 1). Also, in the alternative embodiment, trip lever 302 includes a first end 306 and a second end 308 opposite first end 306. In other embodiments, trip lever 302 is not rotatably coupled to circuit breaker 300, but rather is coupled to circuit breaker 300 to facilitate linear movement, rather than rotational movement of trip lever 302.

In the alternative embodiment, circuit breaker 300 includes a biasing device 310 coupled thereto. Biasing device 310 contacts second end 308 of trip lever 302 and is configured to bias rotation of trip lever 302, as described in further detail below with reference to FIGS. 4 and 5A-5C. In other embodiments, biasing device 310 contacts second end 308 of trip lever 302 and is configured to bias linear movement, rather than rotation, of trip lever 302. Also, in the alternative embodiment, circuit breaker 300 includes two trip levers 302 that contact biasing device 310. Further, in the alternative embodiment, a second biasing device 310 (not shown) may be coupled to a second side of circuit breaker 300 to contact a third trip lever (not shown). In other embodiments, circuit breaker 300 may include a single trip lever 302 contacting biasing device 310.

In operation, in the alternative embodiment, circuit breaker 300 enables flow of current between terminal connectors 104 within a range of current values, as described above with reference to FIG. 1. Also, as described with reference to FIG. 1, if current flow exceeds rated current, a rotatable device (not shown) inside case 102 rotates trip lever 302 from a first position (representative of a low current condition) to a second position (representative of a tripped condition). In other embodiments, the rotatable device exerts a torque to move trip lever 302 in a linear direction, rather than to rotate trip lever 302. Biasing device 310 is biased against second end 308 of trip lever 302. In other embodiments, not shown, continued rotation of the rotatable device with increasing current flow above the rated current causes continued linear movement, rather than rotation, of trip lever 302, leading to contact of first end 306 with trip mechanism 108, and eventual tripping of the circuit breaker 300.

Figure 4:
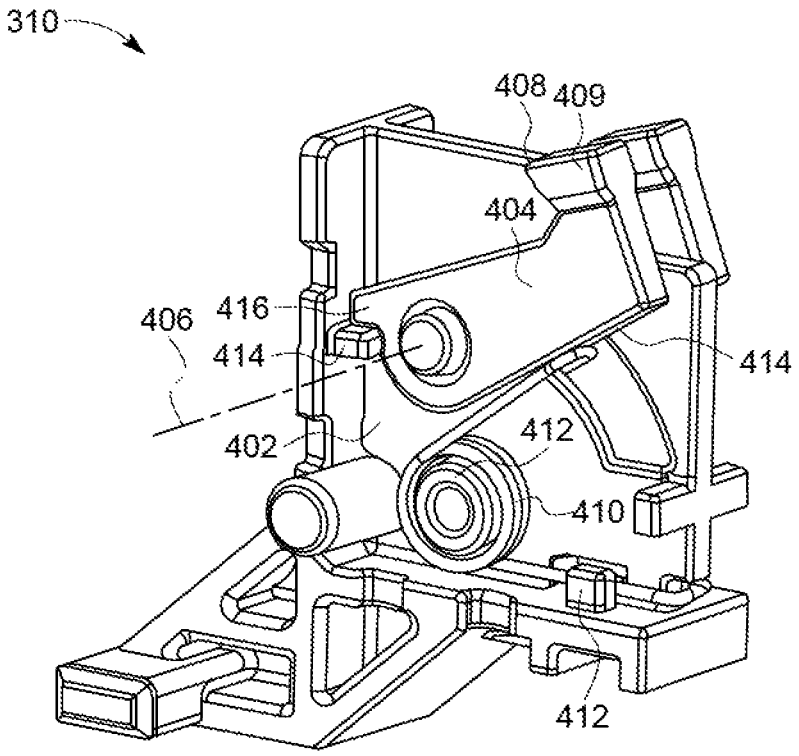
FIG. 4 is a perspective view of an alternative embodiment of a biasing device that may be used in the circuit breaker shown in FIG. 3.

FIG. 4 is a perspective view of biasing device 310 that may be used in circuit breaker 300 shown in FIG. 3. In the alternative embodiment, biasing device 310 includes a housing 402 coupled to circuit breaker 300 (shown in FIG. 3). A lever arm 404 is rotatably coupled to housing 402 and rotates about a lever arm axis of rotation 406. In other embodiments, lever arm 404 is not rotatably coupled to housing 402, but rather is coupled to housing 402 to facilitate linear movement, rather than rotational movement of lever arm 404. Lever arm 404 includes an engagement surface 408 in contact with second end 308 of trip lever 302 (shown in FIG. 3). Engagement surface 408 is defined on a pawl 409 of lever arm 404. Also, in the alternative embodiment, engagement surface 408 includes an arcuate surface. In other embodiments engagement surface 408 may not include an arcuate surface.

Also, in the alternative embodiment, biasing device 310 includes a bias member 410 (including, without limitation, a torsion spring, a tension spring, and a leaf spring) extending between housing 402 and lever arm 404. Bias member 410 is secured between housing 402 and lever arm 404 by at least one housing bias member securement piece 412. Bias member 410 biases engagement surface 408 against second end 308 of trip lever 302. Further, in the alternative embodiment, biasing device 310 includes a stop surface 414. Lever arm 404 also includes a protrusion 416 configured to contact stop surface 414 to restrict rotation of lever arm 404. Moreover, in the alternative embodiment, biasing device 310 includes two lever arms 404 rotatably coupled to housing 402 on opposite sides of housing 402, each lever arm 404 having an associated bias member 410, for example to accommodate contact between biasing device 310 and two trip levers 302 (as shown and described below with reference to FIG. 6). In other embodiments, biasing device 310 may include a single lever arm 404 and a single bias member 410. In such other embodiments where biasing device 310 includes a single bias member 410, biasing device 310 may include two lever arms 404 coupled independently to opposite sides of housing 402, and the single bias member 410 extends through housing 402, but provides spring action upon each of the two lever arms 404 independently.

In operation, in the alternative embodiment, as trip lever 302 rotates counterclockwise in response to current flow exceeding rated current, trip lever 302 causes lever arm 404 to press against bias member 410, thus compressing bias member 410. In other embodiments, linear movement, rather than rotation, of trip lever 302 causes lever arm 404 to press against bias member 410. Compressed bias member 410 biases engagement surface 408 against second end 308 of trip lever 302. Due to a shape of second end 308 of trip lever 302, as further described and shown below with reference to FIGS. 5A-5C, lever arm 404 exerts a first torque having a first value (or a first range of values) upon second end 308 of trip lever 302 in the first position, and lever arm 404 exerts a second torque having a second value (or a second range of values) upon second end 308 of trip lever 302 in the second position, thus facilitating self-resetting of trip lever 302 and trip mechanism 108 (shown in FIG. 3). Also, in operation of the alternative embodiment, the value of the first torque is greater than the value of the second torque. In other embodiments, the value of the second torque is greater than the value of the first torque. The torque characteristic exhibited by circuit breaker 300 with trip lever 302 and biasing device 310, and with trip lever 302 transitioning through intermediate positions between first position and second position is a non-linear torque characteristic regardless of whether the value of the first torque is greater than or less than the value of the second torque.

Figure 5A:
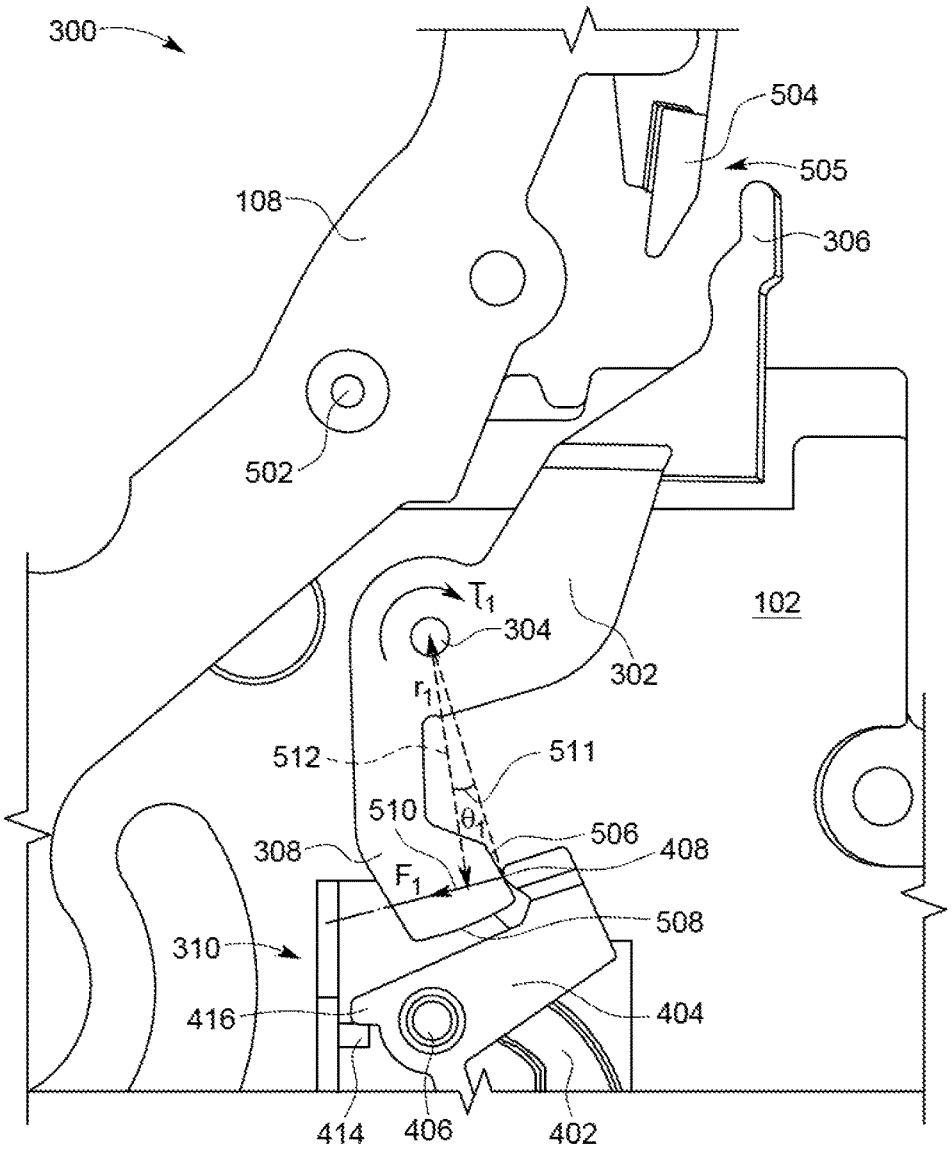
FIG. 5A is a side view of a portion of the circuit breaker shown in FIG. 3 with a trip lever in a first position.
Figure 5B:
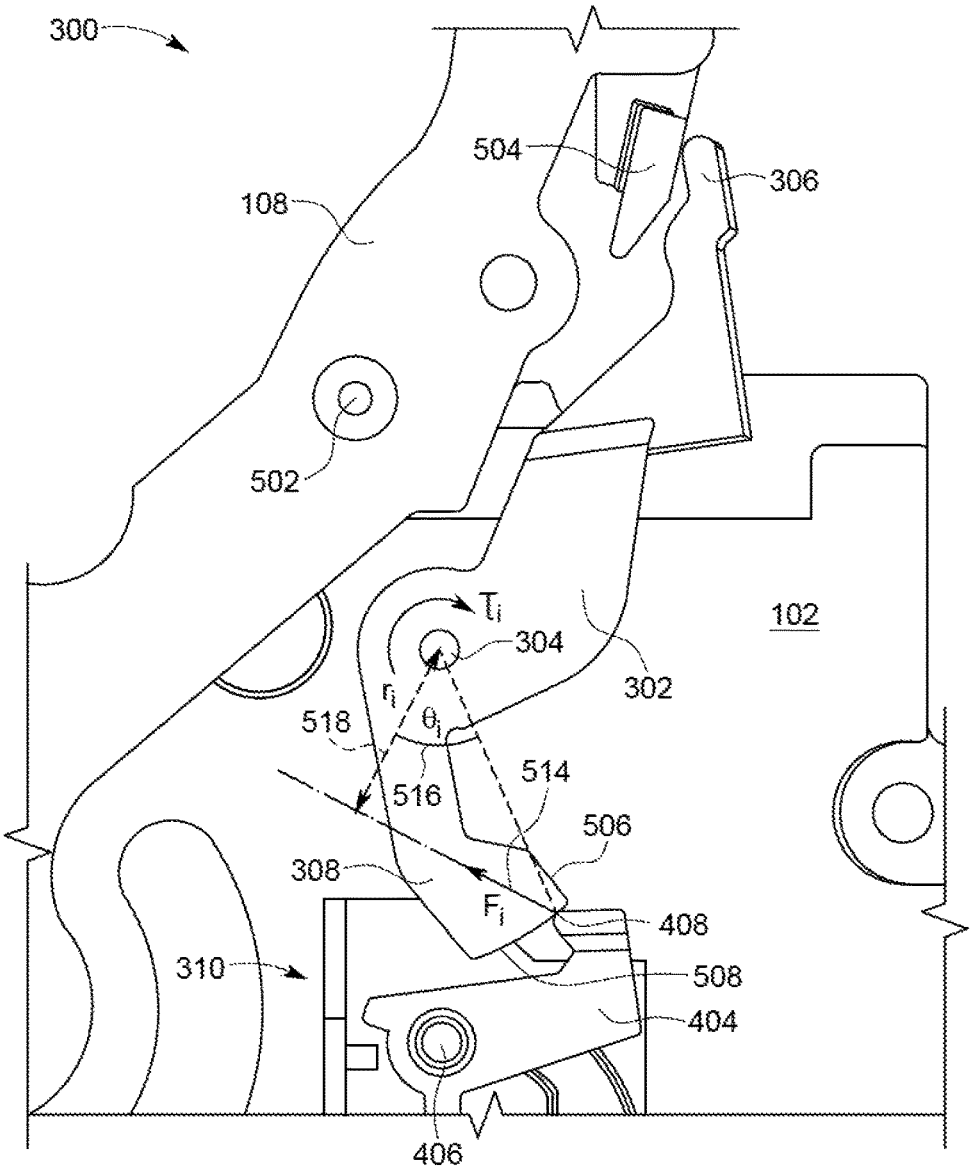
FIG. 5B is a side view of the circuit breaker shown in FIG. 3 with the trip lever in an intermediate position between the first position and a second position.
Figure 5C:
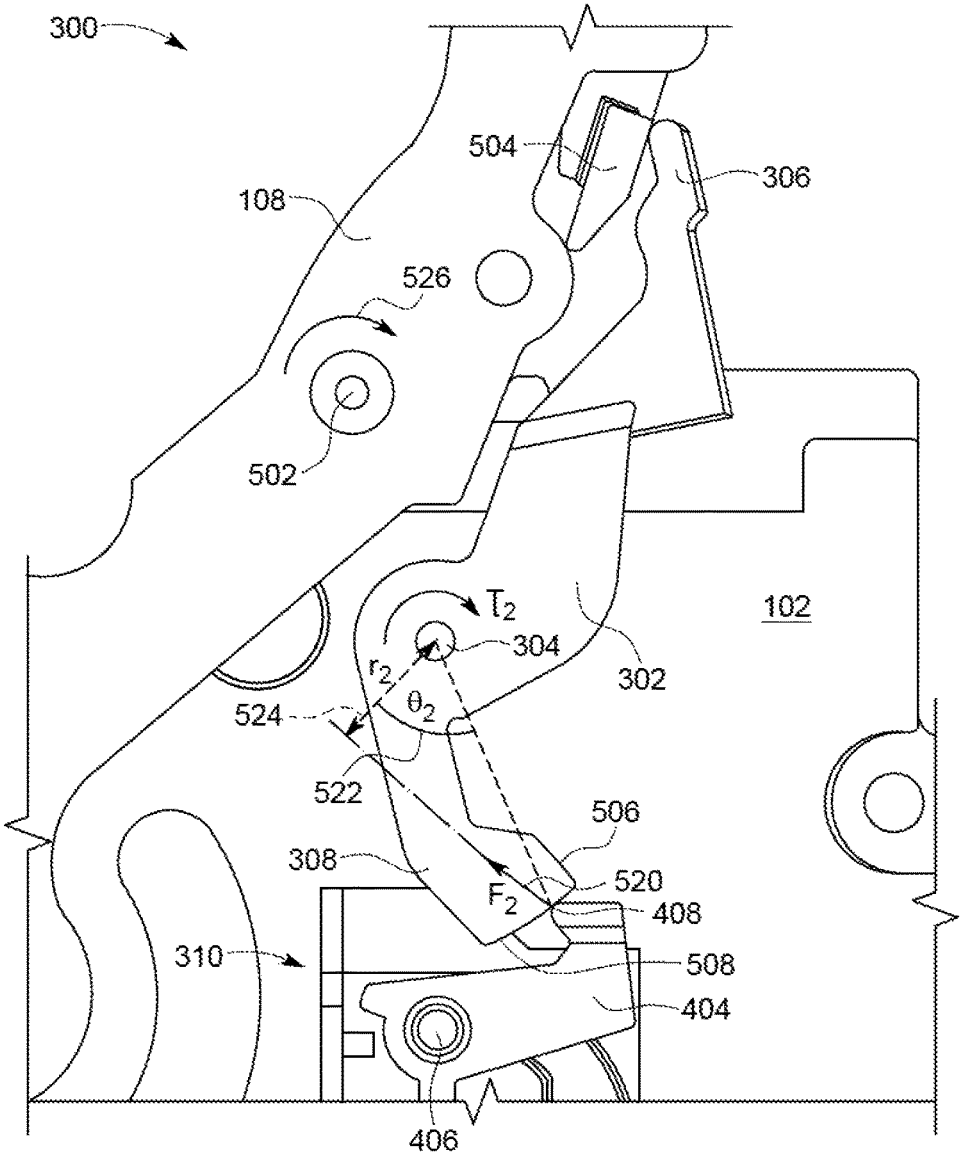
FIG. 5C is a side view of a portion of the circuit breaker shown in FIG. 3 with the trip lever in the second position.

FIG. 5A is a side view of a portion of circuit breaker 300 shown in FIG. 3 with trip lever 302 in the first position. FIG. 5B is a side view of a portion of circuit breaker 300 shown in FIG. 3 with trip lever 302 in an intermediate (i.e., transitional) position between the first position and the second position. FIG. 5C is a side view of a portion of circuit breaker 300 shown in FIG. 3 with trip lever 302 in the second position. In the alternative embodiment, trip mechanism 108 rotates about a trip mechanism axis of rotation 502. Further, in the alternative embodiment, trip mechanism 108 includes a hinged tip 504. Hinged tip 504 is hingedly coupled to trip mechanism 108. Furthermore, in the alternative embodiment, an initial gap 505 is defined between first end 306 and hinged tip 504 when trip lever 302 is in the first position. As such, in first position, first end 306 does not contact hinged tip 504.

Also, in the alternative embodiment, second end 308 of trip lever 302 includes a first surface 506 and a second surface 508. Second surface 508 is oriented substantially orthogonal first surface 506. In other embodiments second surface 508 may have other orientations relative to first surface 506. Further, in the alternative embodiment, second surface 508 is curved concavely and first surface 506 is substantially planar. In other embodiments, second surface 508 may be curved convexly. In still other embodiments, second surface 508 may be substantially planar. In yet other embodiments, first surface 506 may be curved concavely or curved convexly.

With trip lever 302 in the first position (as shown in FIG. 5A), engagement surface 408 of lever arm 404 contacts and is biased against first surface 506 of trip lever 302. Also, in the first position, bias member 410 (shown in FIG. 4) of biasing device 310 is in a relaxed (though not necessarily fully relaxed) position, and protrusion 416 of lever arm 404 contacts stop surface 414 of housing 402. As such, lever arm 404 is in an initial position corresponding to the first position of trip lever 302. With engagement surface 408 in contact with first surface 506, an applied force 510 of magnitude $F_1$ (indicated by a vector arrow in FIG. 5A labeled $F_1$) is exerted by engagement surface 408 upon first surface 506. An angle ($\theta_1$) 511 and a radius ($r_1$) 512 from trip lever axis of rotation 304 determine a first value of bias torque ($\tau_1$) associated with the first position according to the following equation:

$$\tau_1 = r_1 F_1 \sin(\theta_1)$$

where $\tau_1$ acts upon trip lever axis of rotation 304 in a clockwise direction (indicated by a curved arrow in FIG. 5A labeled $\tau_1$).

As current flow in circuit breaker 300 begins to exceed rated current, trip lever begins to rotate as shown and described above with reference to FIGS. 1 and 3, and trip lever 302 rotates to an intermediate position in which first end 306 makes contact with hinged tip 504, as shown in FIG. 5B. Upon first end 306 making contact with hinged tip 504, initial gap 505 is eliminated. In the alternative embodiment, hinged tip 504 is a biased hinge that introduces additional non-linearity to a bias torque characteristic curve (e.g., as shown and described below with reference to FIG. 7). In other embodiments, hinged tip 504 may freely rotate. Further increases in flow of current through circuit breaker 300 causes further rotation of trip lever 302 and hinged tip 504 until hinged tip contacts trip mechanism 108.

During rotation of trip lever 302, engagement surface 408 contacts and traverses second surface 508 of second end 308. At the intermediate position, engagement surface 408 applies a biasing torque upon second end 308 with an applied force 514 of magnitude $F_i$ (indicated by a vector arrow in FIG. 5B labeled $F_i$) exerted upon second surface 508. An angle ($\theta_i$) 516 and a radius ($r_i$) 518 from trip lever axis of rotation 304 determine an intermediate value of bias torque ($\tau_i$) associated with the intermediate position according to the following equation:

$$\tau_i = r_i F_i \sin(\theta_i)$$

where $\tau_i$ acts upon trip lever axis of rotation 304 in a clockwise direction (indicated by a curved arrow in FIG. 5B labeled $\tau_i$).

Upon contact of hinged tip 504 with trip mechanism 108, and with a nominal amount of further rotation of trip lever 302, trip mechanism 108 begins to rotate counter clockwise about trip mechanism axis of rotation 502. Upon reaching a predetermined extent of rotation (which can be a nominal or negligible amount), trip lever 302 reaches the second position (as shown in FIG. 5C) and circuit breaker 300 trips, as described above with reference to FIG. 1. Thus, in the exemplary embodiment, the second position exists for a mere instance in time substantially simultaneously with tripping of circuit breaker 300. At that time, lever arm 404 is in a final position corresponding to the second position of trip lever 302. In other embodiments, the second position of trip lever 302 exists for more than a mere instant of time, including, without limitation, a predetermined amount of time. In the second position, engagement surface 408 applies a biasing torque upon second end 308 with an applied force 520 of magnitude $F_2$ (indicated by a vector arrow in FIG. 5C labeled $F_2$) exerted upon second surface 508. An angle ($\theta_2$) 522 and a radius ($r_2$) 524 from trip lever axis of rotation 304 determine a second value of bias torque ($\tau_2$) associated with the second position according to the following equation:

$$\tau_2 = r_2 F_2 \sin(\theta_2)$$

where $\tau_2$ acts upon trip lever axis of rotation 304 in a clockwise direction (indicated by a curved arrow in FIG. 5C labeled $\tau_2$).

Tripping of circuit breaker 300 releases stored potential energy from rotatable device inside case 102 (as described above with reference to FIG. 1), which causes a forceful counter-rotation 526 of trip mechanism 108 in a clockwise direction (indicated by a curved arrow in FIG. 5C labeled 526). This counter-rotation 526 rotates trip lever 302 back to the first position, thereby self-resetting trip lever 302. Substantially the same aforementioned sequence of positions (i.e., from first position through the intermediate position, from intermediate position to second position, and then tripping with subsequent self-resetting of trip lever 302) also applies to circuit breaker 100 with trip lever 110 and biasing device 118 as shown and described above with reference to FIGS. 1 and 2.

Figure 6:
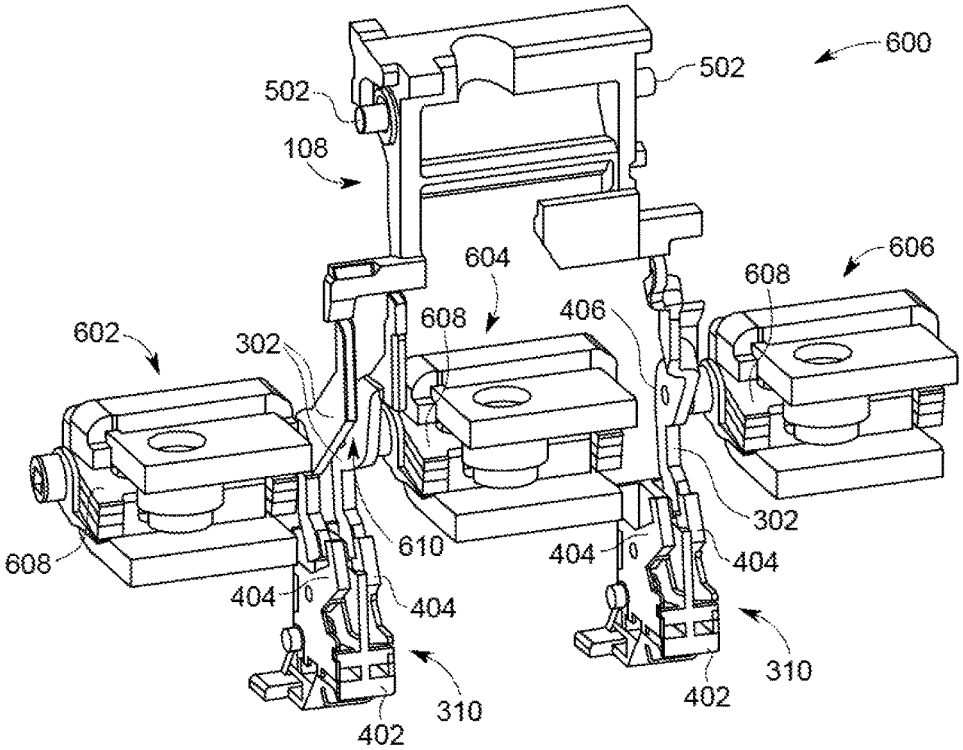
FIG. 6 is a perspective view of an exemplary embodiment of an assembly that includes a trip mechanism, trip levers, and biasing devices that may be used in the circuit breaker shown in FIG. 3.

FIG. 6 is a perspective view of an exemplary embodiment of an assembly 600 that includes trip mechanism 108, trip levers 302, and biasing devices 310 that may be used in circuit breaker 300 shown in FIG. 3. In the exemplary embodiment, two biasing devices 310 are coupled to opposing sides of circuit breaker 300 (shown in FIG. 3). Also, in the exemplary embodiment, circuit breaker 300 is configured to alternately enable and disable current flow between terminal connectors 104 (shown in FIG. 3) in a multi-pole electrical circuit, for example a 3-pole circuit system used in a 3-phase alternating current (AC) power system. Thus, circuit breaker 300 includes three poles: a first pole 602, a second pole 604, and a third pole 606. Each pole of the aforementioned three poles 602, 604, and 606 includes a rotatable device 608, including, without limitation, a magnetic coil-based device, rotatably coupled to respective trip levers 302, as shown and described above with reference to FIG. 1.

In operation, in the exemplary embodiment, assembly 600 of circuit breaker 300 is configured to detect and respond to current flow exceeding rated current in individual poles of the three separate poles 602, 604, and 606. For this functionality, poles 602, 604, and 606 are spaced apart (i.e., physically separated by a gap 610) from one another to ensure that one pole does not influence the other poles' performance characteristics in circuit breaker 300. Also, in operation of the exemplary embodiment, each pole of the three separate pole 602, 604, and 606 is rotatably coupled to a respective rotatable device 608, facilitating electromagnetic and/or electromechanical separation in addition to physical separation provided by gap 610.

Also, assembly 600 may be used with both circuit breaker 100 and circuit breaker 300. When used with circuit breaker 300, assembly 600 does not sum electromagnetic forces from respective rotatable devices 608 of two or more of poles 602, 604, and 606 experiencing increased current flow therethrough that is above the rated current. Therefore, tripping of circuit breaker 300 occurs less quickly than in circuit breakers not having assembly 600. Also, use of assembly 600 with circuit breaker 300 improves efficiency and effectiveness of maintenance and calibration activities. Assembly 600 used with circuit breaker 100, on the other hand, permits summing electromagnetic forces from respective rotatable devices 608 of two or more of poles 602, 604, and 606 experiencing increased current flow above the rated current, thus enabling faster tripping relative to circuit breaker 300. Furthermore, using assembly 600 with circuit breaker 100 or circuit breaker 300 provides additional options for tuning and calibration of circuit breaking performance characteristics, as described above with reference to FIG. 1.

Figure 7:
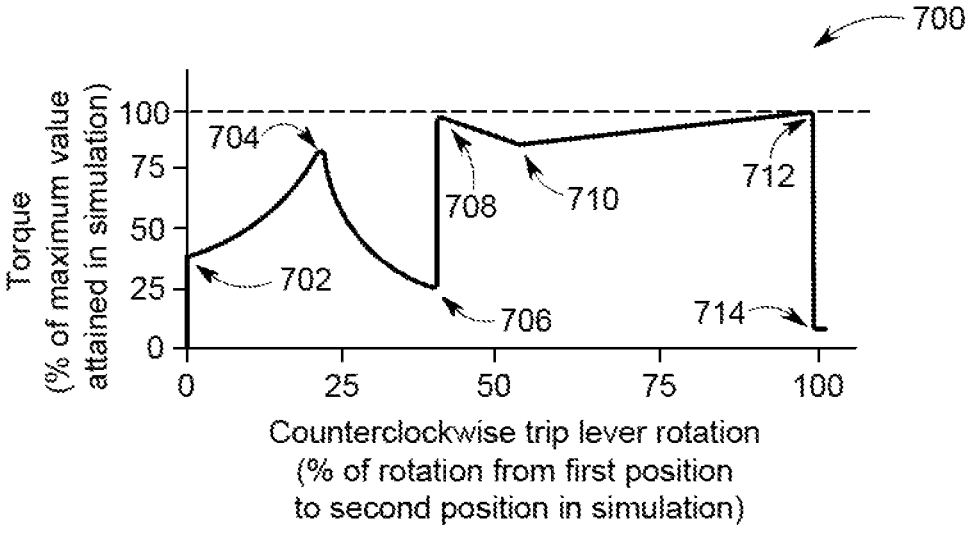
FIG. 7 is a plot of an exemplary simulation of biasing torque versus trip lever rotation from the first position to the second position for the circuit breaker shown in FIGS. 3 and 5A-5C.

FIG. 7 is a plot 700 of an exemplary simulation of biasing torque versus trip lever rotation from the first position to the second position for circuit breaker 300 shown in FIGS. 3 and 5A-5C. In plot 700, a y-axis represents values of bias torque as a percent (%) of a maximal torque attained during the exemplary simulation (i.e., 100%). Also, in plot 700, an x-axis represents counterclockwise rotational angle (e.g., degrees) as a % of rotation of trip lever 302 from first position to second position (i.e., 0% represents trip lever 302 in first position and 100% represents trip lever 302 in second position). In the first position, first end 306 of trip lever 302 does not contact hinged tip 504 and initial gap 505 is present. Also, in the first position at a point 702, circuit breaker 300 has current flow at or below rated current and biasing device 310 biases trip lever 302 with approximately 32% of the maximal torque attained during the exemplary simulation.

As shown by plot 700, a roughly exponential growth in torque occurs between point 702 at 0% rotation and a point 704 at approximately 23% rotation as current flow increases above rated current and causes rotation of trip lever 302. During this period of the exemplary simulation, initial gap 505 begins to close between first end 306 and hinged tip 504. Also, during the period of the exemplary simulation between points 702 and 704, engagement surface 408 traverses first surface 506 and bias member 410 biases engagement surface 408 against second end 308 at first surface 506 thereof. A roughly exponential decay in torque then occurs between point 704 and a point 706 at approximately 42% rotation. Between points 704 and 706, engagement surface 408 is nearing, but has not yet reached second surface 508 of second end 308, and torque decreases from approximately 81% of the maximal torque attained during the exemplary simulation at point 704 to approximately 26% maximal torque at point 706.

Next, in the exemplary simulation, trip lever 302 experiences a rapid rise in torque between point 706 and a point 708 at approximately 43% rotation. During this period of the exemplary simulation, engagement surface 408 contacts second end 308 at an intersection region between first surface 506 and second surface 508, and initial gap 505 closes completely. At point 708, torque is at approximately 97% maximal torque and first end 306 continues to impinge upon hinged tip 504. Trip lever 302 experiences a substantially linear decrease in torque to approximately 85% of maximal torque between point 708 and a point 710 at approximately 55% rotation, as engagement surface 408 traverses the intersection region between first and second surfaces 506 and 508 to reach second surface 508. Moreover, in the exemplary simulation, trip lever 302 experiences a substantially linear increase in torque to 100% of maximal torque between point 710 and a point 712 at approximately 99% rotation. Between points 710 and 712, first end 306 impinges upon hinged tip 504 still further, and hinged tip 504 is nearing, but has not yet contacted, trip mechanism 108.

Next, in the exemplary simulation, trip lever 302 experiences a rapid decrease in torque to approximately 7% of maximal torque between point 712 and a point 714 at 100% rotation. At point 712, hinged tip 504 makes contact with trip mechanism. From point 712 to point 714, torque decreases from 100% of maximal torque to approximately 7% of maximal torque due to the counter-rotation 526 of trip mechanism 108 (as shown and described above with reference to FIG. 5C) and trip lever 302 returns to the first position (i.e., trip lever 302 self-resets).

Plot 700 is an exemplary plot of data obtained in an exemplary simulation of a particular exemplary embodiment of circuit breaker 300, resulting in a non-linear torque characteristic as shown and described above with reference to FIG. 7. Depending on particular applications and design characteristics of features of circuit breaker 300, and likewise, of circuit breaker 100, particular torque characteristics may vary, but still maintain a non-linear torque characteristic curve (as shown in FIG. 7) that results through substantially the same mechanisms described herein. For example, in other embodiments, simulation plots constructed as described above may have greater than or less than the number of points shown in FIG. 7, and may experience behavior between any pair of points 702, 704, 706, 708, 710, 712, 714, and other points as applicable, that differs from that shown in FIG. 7, but still retain a non-linear torque characteristic between first position (0% rotation) and second position (100% rotation). In such other embodiments, for example, an approximately exponential growth or decay between points 702 and 704 and points 704 and 706, respectively, may instead be a roughly linear growth or decay, respectively. Likewise, such periods of approximately exponential growth or decay may instead be periods of approximately logarithmic growth or decay, respectively. Similarly, in simulation plots of such other embodiments, periods of increasing or decreasing behavior of biasing torque may instead be periods for which the torque characteristic remains substantially constant. Furthermore, the torque characteristic exhibited by circuit breaker 300 with trip lever 302 and biasing device 310 (and likewise, by circuit breaker 100 with trip lever 110 and biasing device 118), and with trip lever 302 (or trip lever 110) transitioning through intermediate positions between first position and second position is a non-linear torque characteristic regardless of whether the value of the first torque at the first position is greater than or less than the value of the second torque at the second position.

Figure 8:
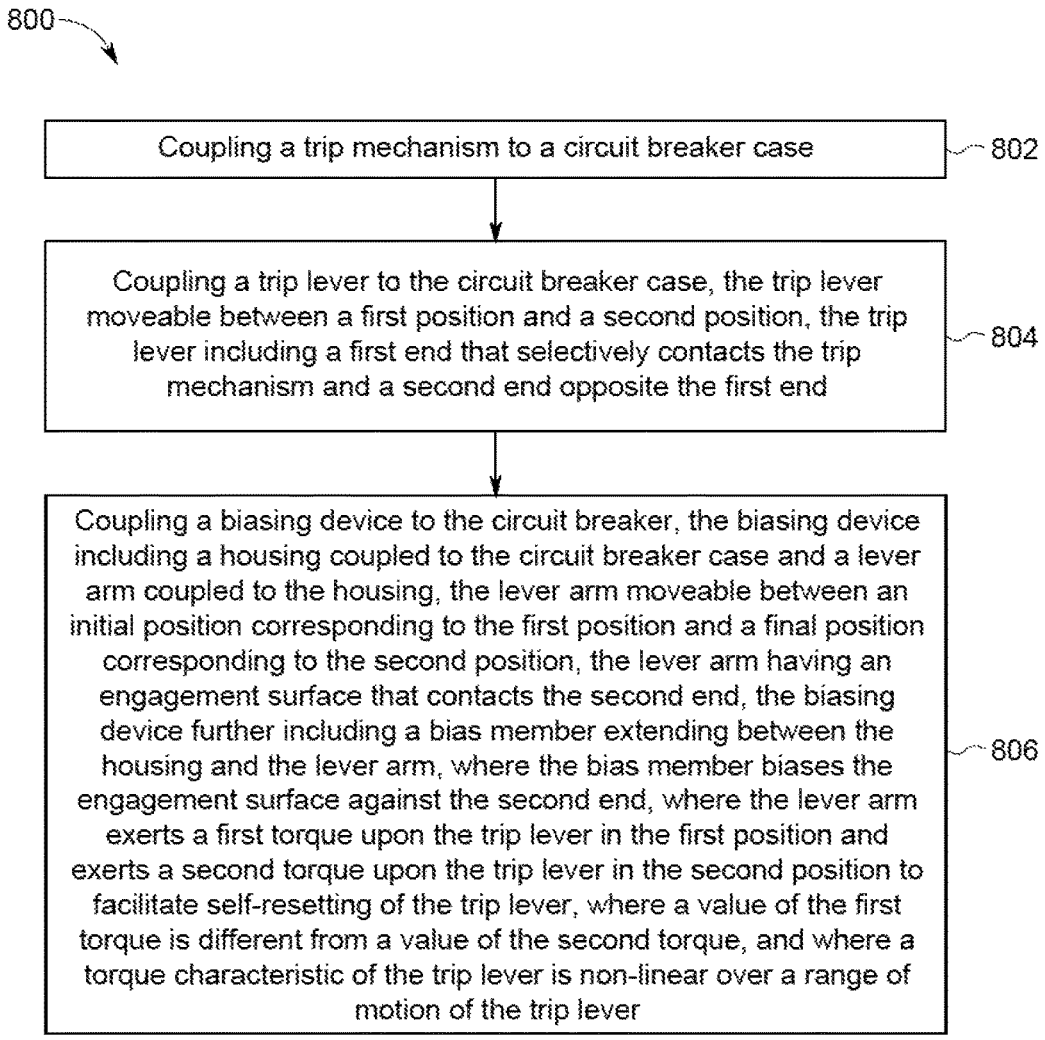
FIG. 8 is a flowchart of an exemplary method of assembling a circuit breaker that may be used to assemble the circuit breakers shown in FIGS. 1 and 3.

FIG. 8 is a flowchart of an exemplary method 800 of assembling a circuit breaker that may be used to assemble circuit breaker 100 or circuit breaker 300 shown in FIGS. 1 and 3, respectively. Method 800 includes coupling 802 a trip mechanism, for example trip mechanism 108, to a circuit breaker case (e.g., case 102 of circuit breaker 100 or circuit breaker 300). In the exemplary embodiment, the trip mechanism is rotatably coupled to the circuit breaker case. In other embodiments, trip mechanism is not rotatably coupled to circuit breaker case, but rather is coupled to circuit breaker case to facilitate linear movement, rather than rotational movement, of the trip mechanism. Method 800 also includes coupling 804 a trip lever, for example trip lever 110 (or trip lever 302) to the circuit breaker case to facilitate a movement of the trip lever between a first position corresponding to a low current condition of the circuit breaker and a second position corresponding to a tripped condition of the circuit breaker. In the exemplary embodiment, the trip lever is rotatably coupled to the circuit breaker case. In other embodiments, trip lever is not rotatably coupled to the circuit breaker case, but rather is coupled to circuit breaker case to facilitate linear movement, rather than rotational movement, of the trip lever. The trip lever includes a first end, for example first end 114 (or first end 306), that selectively contacts the trip mechanism. The trip lever also includes a second end, for example second end 116 (or second end 308) opposite the first end.

Method 800 further includes coupling 806 a biasing device, for example biasing device 118 (or biasing device 310), to the circuit breaker case. The biasing device includes a housing (e.g., housing 202 or housing 402) and a lever arm (e.g., lever arm 204 or lever arm 404) coupled to the housing to facilitate a movement of the lever arm between an initial position corresponding to the first position of the trip lever and a final position corresponding to the second position of the trip lever. In the exemplary embodiment, the lever arm is rotatably coupled to the housing. In other embodiments, lever arm is not rotatably coupled to housing, but rather is coupled to housing to facilitate linear movement, rather than rotational movement, of the lever arm. The lever arm includes an engagement surface (e.g., engagement surface 206 or engagement surface 408) that contacts the second end of the trip lever. The lever arm also includes a bias member (e.g., bias member 214 or bias member 410) extending between the housing and the lever arm, where the bias member biases the engagement surface against the second end of the trip lever. The lever arm exerts a first torque upon the trip lever (e.g., about trip lever axis of rotation 112 or trip lever axis of rotation 304) in the first position. The lever arm exerts a second torque upon the trip lever (e.g., about trip lever axis of rotation 112 or trip lever axis of rotation 304) in the second position, where a value of the first torque value is different from (i.e., is greater than or, alternatively, is less than) a value of the second torque. Furthermore, in the exemplary embodiment, a torque characteristic of the movement of the trip lever (i.e., movement of trip lever through intermediate positions between first position and second position as shown in FIG. 7, for example) is non-linear.

The above-described embodiments of self-resetting biasing devices and associated systems and methods of use thereof provide non-linear opposing torque profiles to trip systems for current limiting circuit breakers. The above-described embodiments also facilitate meeting regulatory requirements that require circuit breakers to avoid tripping at lower level currents and to deliver tripping at higher level fault currents. The above-described embodiments are further suited to resetting the biasing system without manual user intervention. The above-described embodiments of self-resetting biasing devices and associated systems and methods of use thereof are also suited to preventing a biasing force from being applied to trip levers after unlatching and thus, enable tripping the mechanism within a half cycle of the fault current (e.g., within 4-5 ms). The above-described embodiments are further suited to enabling tuning specific circuit breaker performance characteristics including, without limitation, rated current value, time to trip when current flow exceeds rated current, and self-resetting of trip mechanisms. The above-described embodiments are also suited to providing a current limiting circuit breaker device suitable for applications demanding both UL and IEC requirements.

Exemplary embodiments of the above-described self-resetting non-linear biasing devices and associated systems and methods of use thereof are not limited to the specific embodiments described herein, but rather, components of systems and/or steps of the methods may be utilized independently and separately from other components and/or steps described herein. For example, the methods, systems, and apparatus may also be used in combination with other systems requiring self-resetting non-linear biasing devices, and the associated methods are not limited to practice with only the systems and methods as described herein. Rather, the exemplary embodiments can be implemented and utilized in connection with many other applications, equipment, and systems that may benefit from using the above-described embodiments of the above-described self-resetting non-linear biasing devices and associated systems and methods of use thereof to improve the safety, reliability, versatility, and efficiency of operation for circuit breakers in electrical power systems and other related systems in various applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit breaker including a case, said circuit breaker comprising:

a trip mechanism;

a trip lever coupled to the case and configured to move between a first position and a second position, said trip lever comprising a first end that selectively contacts said trip mechanism and a second end opposite said first end, wherein said trip lever first end does not contact said trip mechanism in the first position, and wherein the first position corresponds to a low current condition; and a biasing device comprising:

a housing coupled to the case;

a lever arm coupled to said housing and comprising an engagement surface in contact with said second end, said lever arm configured to move between an initial position corresponding to the first position and a final position corresponding to the second position; and a bias member extending between said housing and said lever arm and biasing said engagement surface against said trip lever second end such that said engagement surface contacts said trip lever second end in both the trip lever first position corresponding to the low current condition and the trip lever second position, wherein said lever arm exerts a first torque upon said trip lever in the first position and exerts a second torque upon said trip lever in the second position, and wherein a value of the first torque is different from a value of the second torque.

2. A circuit breaker in accordance with claim 1, wherein said bias member comprises at least one of a coil spring, a torsion spring, a tension spring, and a leaf spring.

3. A circuit breaker in accordance with claim 1 further comprising an additional bias member comprising at least one of a leaf spring, a torsion spring, a ball catch mechanism, and a cam-biased spring mechanism, said additional bias member extending between said housing and said lever arm, said additional bias member further biasing said lever arm against said second end.

4. A circuit breaker in accordance with claim 1, wherein said bias member comprises at least two bias members.

5. A circuit breaker in accordance with claim 1 further comprising at least one additional trip lever arranged to selectively contact said lever arm.

6. A circuit breaker in accordance with claim 1 further comprising a second lever arm coupled to said housing.

7. A circuit breaker in accordance with claim 1 further comprising a tip hingedly coupled to said trip mechanism.

8. A circuit breaker in accordance with claim 1, wherein said second end comprises a first surface and a second surface oriented substantially orthogonal to said first surface.

9. A circuit breaker in accordance with claim 8, wherein said second surface is arcuate.

10. A circuit breaker in accordance with claim 1, wherein a torque characteristic of said trip lever is non-linear over a range of motion of said trip lever.

11. A biasing device for a circuit breaker having a case, a trip mechanism, and a trip lever coupled to the case and configured to move between a first position and a second position, the trip lever including a first end that selectively contacts the trip mechanism and a second end opposite the first end, wherein the trip lever first end does not contact the trip mechanism in the first position, and wherein the first position corresponds to a low current condition, said biasing device comprising:

a housing coupled to the case;

a lever arm coupled to said housing and comprising an engagement surface in contact with the second end, said lever arm configured to move between an initial position corresponding to the first position and a final position corresponding to the second position; and a bias member extending between said housing and said lever arm and biasing said engagement surface against the trip lever second end such that said engagement surface contacts the trip lever second end in both the trip lever first position corresponding to the low current condition and the trip lever second position, wherein said lever arm exerts a first torque upon the trip lever in the first position and exerts a second torque upon the trip lever in the second position, and wherein a value of the first torque is different from a value of the second torque.

12. A biasing device in accordance with claim 11, wherein said housing comprises a stop surface, and wherein said lever arm further comprises a protrusion that contacts said stop surface to restrict a movement of said lever amt.

13. A biasing device in accordance with claim 11, wherein said bias member comprises at least one of a coil spring, a torsion spring, a tension spring, and a leaf spring.

14. A biasing device in accordance with claim 11, wherein said lever arm is rotatably coupled to said housing.

15. A biasing device in accordance with claim 11 further comprising an additional bias member comprising at least one of a leaf spring, a torsion spring, a ball catch mechanism, and a cam-biased spring mechanism, said additional bias member extending between said housing and said lever arm, said additional bias member further biasing said lever arm against the second end.

16. A biasing device in accordance with claim 11 further comprising a second lever arm coupled to said housing.

17. A biasing device in accordance with claim 11, wherein a torque characteristic of the trip lever is non-linear over a range of motion of the trip lever.

18. A method of assembling a circuit breaker, said method comprising:

coupling a trip mechanism to a circuit breaker case;

coupling a trip lever to the circuit breaker case, the trip lever moveable between a first position and a second position, the trip lever including a first end that selectively contacts the trip mechanism and a second end opposite the first end, wherein the trip lever first end does not contact the trip mechanism in the first position, and wherein the first position corresponds to a low current condition; and coupling a biasing device to the circuit breaker, the biasing device including a housing coupled to the circuit breaker case and a lever arm coupled to the housing, the lever arm moveable between an initial position corresponding to the first position and a final position corresponding to the second position, the lever arm having an engagement surface that contacts the second end, the biasing device further including a bias member extending between the housing and the lever arm, wherein the bias member biases the engagement surface against the trip lever second end such that the engagement surface contacts the trip lever second end in both the trip lever first position corresponding to the low current condition and the trip lever second position, wherein the lever arm exerts a first torque upon the trip lever in the first position and exerts a second torque upon the trip lever in the second position to facilitate self-resetting of the trip lever, wherein a value of the first torque is different from a value of the second torque, and wherein a torque characteristic of the trip lever is non-linear over a range of motion of the trip lever.

19. A method device in accordance with claim 18, wherein the lever arm is rotatably coupled to the housing.

20. A biasing device in accordance with claim 1, wherein said lever arm is rotatably coupled to said housing.

* * * * *